United States Patent [19]

Hall

[11] Patent Number: 4,622,766

[45] Date of Patent: Nov. 18, 1986

[54] HAND HELD SUCTION NOZZLE WITH METAL DETECTOR

[76] Inventor: Gary R. Hall, 6089 Sanibel-Captiva Rd., Sanibel Island, Fla. 33957

[21] Appl. No.: 740,503

[22] Filed: Jun. 3, 1985

[51] Int. Cl.[4] ..... E02F 3/88

[52] U.S. Cl. ..... 37/58; 37/DIG. 19; 324/326

[58] Field of Search ..... 37/54, 58, DIG. 19; 324/326–329; 15/339

[56] References Cited

U.S. PATENT DOCUMENTS

| | | | |
|---|---|---|---|
| 3,930,324 | 1/1976 | Wightman et al. | 324/329 X |
| 4,289,355 | 9/1981 | Rose | 37/58 X |
| 4,300,260 | 11/1981 | Hill | 15/339 |
| 4,352,251 | 10/1982 | Sloan | 37/58 |
| 4,359,686 | 11/1982 | Wherry | 324/326 |
| 4,423,559 | 1/1984 | Malin | 37/58 |
| 4,476,607 | 10/1984 | Ross | 15/339 |

*Primary Examiner*—Clifford D. Crowder

[57] ABSTRACT

A device connecting a suction dredge to a metal detector search coil, providing a movable suction tube held perpendicular to the search coil, and centered approximately over the coil's area of maximum sensitivity, further allowing said suction tube to be moved down through the search coil to bring its inlet close enough to the detected object to draw it into the tube. The device may be constructed of standard plastic pipe and fittings of the plumbing type, electrical conduit, or any non-metallic substance such as might be used in commercial plastic production. Through the use of snap on/bolt design it is possible to quickly remove the device from the search coil and return the coil to its original configuration and mode of operation.

1 Claim, 4 Drawing Figures

HAND HELD SUCTION NOZZLE WITH METAL DETECTOR

FIELD OF INVENTION

This invention relates to the art of treasure hunting and specifically to the method of retrieving an object from shallow water after it has been located by a metal detector.

DISCUSSION OF PRIOR ART

Currently persons using metal detectors to locate coins, and other valuables in shallow water use long handled scoops to retrieve the object. The hunter will slowly sweep the bottom with his search coil until an object is detected. The hunter will then bring the scoop to the spot where the object (now called the target) is located, remove the search coil from the area to avoid damaging it with the scoop, and drive the scoop into the bottom so as to lever it up under the target. The target is then raised to the surface in the scoop. The scoop will usually contain a large amount of sand, mud, shells etc. as well as, hopefully, the target and in all may weigh as much as 20 pounds. This must then be held partially submerged in the water and shaken to wash out most of the sand and debris in order to get the target. If, as is often the case, the target has not been retrieved, the entire process must be repeated. Even under ideal conditions such as in calm lakes, this process is tedious and time consuming. At large lakes and ocean beaches, even relatively small waves greatly multiply the difficulties involved. They make the water too cloudy to permit the hunter to see his search coil and scoop. If the target has not been retrieved in the first attempt, the hole will have been filled in by wave action. No metal detector currently on the market is capable of both working in salt water and discriminating between aluminum junk, such as the pull tabs of beverage cans, and gold jewelry. It is therefore often necessary for a hunter to find and scoop up many junk targets in order to get one good one. A ratio of fifty junk targets to one good one is not uncommon. In some areas ratios of over one hundred to one occur. Some hunters have attempted to use a suction dredge to retrieve coins and jewelry by working in teams of two or three with one man operating the detector and one or two men to control the dredge. Besides the disadvantage of needing a team to hunt, it is very difficult for the detector operator and the dredge operator to coordinate their efforts when neither can see the bottom, nor their equipment. Attempts by a single operator to use both a detector and a dredge as two separate pieces of equipment have proven so awkward as to offer no advantage over the scoop method.

OBJECTS

It is an object of this invention to provide a device for retrieving targets with much less time and effort. As a means to that objective, it is an object to provide a device to couple a metal detector search coil with a suction dredge in a way which permits a single operator to use both to locate targets, and rapidly retrieve them. This would make it possible for a hunter to locate and retrieve many more targets in a given time than could be accomplished by the scoop method. Obviously the more targets a hunter retrieves, the greater the chance of making a valuable find. The invention realizes these objects by providing a device which joins a dredge suction hose to a non-metallic tube assembly which is held above the target center area of a metal detector search coil. The assembly is held perpendicular to said coil and may be moved down through it so that the inlet of the tube extends beneath the coil and into the sand, mud etc. of the bottom. The tube may extend a distance approximately equal to the useful detection depth of the detector. This enables the dredge to draw the target up through the tube assembly and deposit it into the collector of the dredge. Another feature of this invention is that it accomplishes the connection with no modification of the search coil, so that the coil may be removed from the tube assembly, and returned to its original configuration and mode of operation.

BRIEF DESCRIPTION OF THE DRAWING

This invention is more fully described with reference to the accompanying drawing in which.

DESCRIPTION OF THE PREFERRED EMBODIMENT

Figure 1:
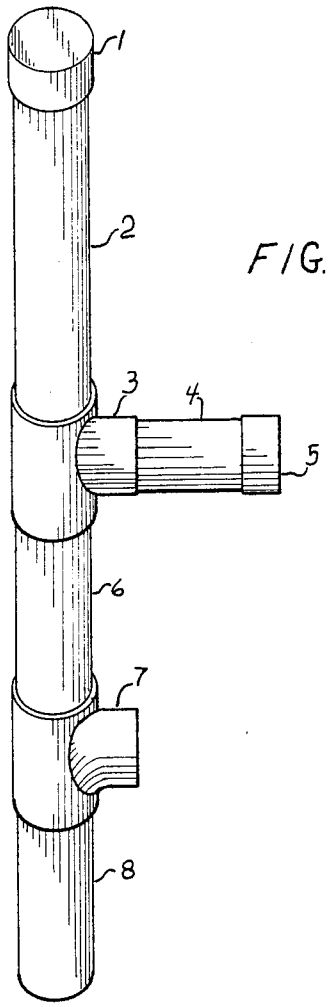
FIGS. 1,2 and 3 show the parts of the invention.
Figure 2:
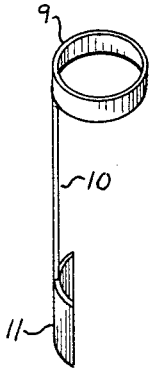
Figure 3:
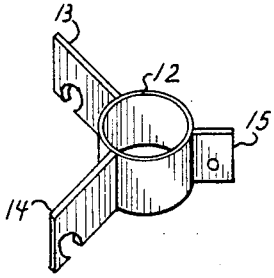
Figure 4:
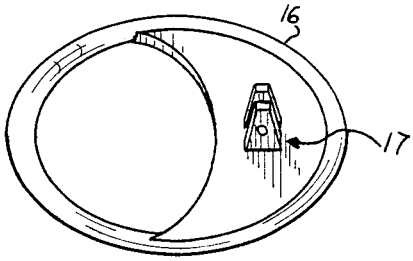
FIG. 4 is a common underwater search coil.

FIG. 1 show the tube assembly which functions as the suction tube and also as a handle. Parts 1,2,3,4 and 5 being the handle portion comprised of caps 1 and 5 and tubes 2 and 4 connected by tee 3 which can be either a straight tee or a long turn tee. Tube 6 serves to join the handle portion to the suction portion comprised of tee 7 and tube 8. It is at tee 7 that the assembly is connected with a dredge by fitting the dredge suction hose either over the end of tee 7 or into it. It is desirable to have the suction hose diameter greater than the diameter of the suction tube 8 as this lessens the chance of an object being drawn through the suction tube and becoming lodged in the suction hose. FIG. 2 shows the guide assembly portion of the invention which is comprised of a ring 9 which loosely encircles tube 6 of FIG. 1, a connecting bar 10 and a portion of a ring 11 which is secured to part 12 of FIG. 3 between legs 13 and 14. This assembly serves to hold the tube assembly of FIG. 1 in its position perpendicular to the search coil and limits the up and down travel of the tube assembly, in accordance with the length of connecting bar 10. FIG. 3 shows the clamp assembly portion of the invention. The clamp assembly is comprised of a ring 12 to which are joined two legs 13 and 14 and a lug 15. Legs 13 and 14 are made of a non-metallic material which should have a slight degree of elasticity so that a semi-circular hole of appropriate diameter and somewhat more than 180 degrees in arc will provide a tight snap on fitting to the search coil FIG. 4. The lug 15 is secured to ring 12 in a position to enable it to fit between the original handle mounts of the search coil parts 17 of FIG. 4 and is provided with a hole spaced so that a pin or bolt may pass through the holes in part 17 and 15 securing the entire assembly of FIG. 3 and thus FIGS. 1 and 2 as well to the search coil FIG. 4. Parts 13,14 and 15 are more or less evenly spaced around ring 12 at intervals of about 120 degrees. Rings 9 and 12 are sized to allow a considerable clearance between themselves and the tubes which slide through them 6 and 8 respectively. This prevents grains of sand from becoming lodged between the parts of the assembly inhibiting their movement. It may be preferable to substitute a third leg similar to 13 and 14 in place of the lug 15, for use with another common type of search coil. All of the parts of the assembly in FIGS. 1,2 and 3 may be standard plastic pipe fittings are used in plumbing or electrical conduit. If commercially manufactured, various portions of the assembly may be cast or molded in sections not exactly corresponding in design or number to the parts of FIG. 1 without affecting the overall embodiment of the invention. In use the portions of the invention shown as FIGS. 1,2 and 3 are assembled as previously described and the invention is attached to the search coil FIG. 4, as described. The dredge suction hose is attached at tee 7 and the dredge throttle cable attached to the handle portion of assembly FIG. 1 wherever convenient to the operator. With the dredge engine at idle the hunter searches the bottom until a target is detected. Holding the assembly over the spot where the strongest signal is obtained the hunter revs up the dredge engine and pushes down on the handle of the assembly. When the suction tube 8 reaches the target the flow of water into the inlet will draw the target up, causing a rapid increase then loss of the signal. When the signal vanishes the hunter throttles back the engine, lifts the assembly enough to withdraw the suction tube 8 into ring 12 and continues hunting.

I claim:

1. Apparatus for detecting and dredging metallic objects comprising:

a hand held suction nozzle including a handle portion to be grasped by an operator, a suction inlet, a connection leading to a suction source and a tube joining the suction inlet to the handle portion;

a metal detector slidably attached to the suction nozzle, a clamp assembly for attaching said metal detector to said nozzle including a first ring loosely fitted around the suction nozzle for sliding movement and secured to the metal detector by a plurality of mounting legs, a bar fixed to said ring and extending along said suction nozzle and said tube, and a second ring loosely encircling said tube for sliding movement and fixed to said bar, whereby upon detection of a metal object by said detector said suction nozzle may be slidingly moved through said rings into the proximity of said detected object for removal thereof by suction.

* * * * *